US006340131B1

(12) United States Patent
Mund et al.

(10) Patent No.: US 6,340,131 B1
(45) Date of Patent: Jan. 22, 2002

(54) METHOD FOR OPERATING AN AUTOMATIC CHEESE WINDER WHEN CHANGING BATCHES

(75) Inventors: Manfred Mund, Herzogenrath; Michael Haines, Nettetal; Michael Iding, Geldern; Torsten Forche; Stefan Terorde, both of Hamminkeln/Dingden; Bernd-Rudiger Theele, Aachen; John-Adrian Holt, Monchengladbach; Heinz-Peter Lindemann, Willich, all of (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/447,495

(22) Filed: Nov. 23, 1999

(30) Foreign Application Priority Data

Nov. 25, 1998 (DE) ..... 198 54 375

(51) Int. Cl.[7] ..... B65H 67/02

(52) U.S. Cl. ..... 242/474; 242/474.1; 242/474.2; 414/811; 198/347.4

(58) Field of Search ..... 242/474, 474.1, 242/474.2; 198/347.4, 465.2; 414/811, 416

(56) References Cited

U.S. PATENT DOCUMENTS

| | | | | |
|---|---|---|---|---|
| 4,576,341 A | | 3/1986 | Matsui et al. | 242/35.5 |
| 4,613,091 A | * | 9/1986 | Kiriake | 242/474.1 |
| 4,846,618 A | * | 7/1989 | Matsui | 198/465.2 X |
| 4,856,723 A | | 8/1989 | Tone | 242/35.5 |
| 4,913,373 A | | 4/1990 | Ueda | 242/35.5 |

(List continued on next page.)

FOREIGN PATENT DOCUMENTS

| | | | |
|---|---|---|---|
| DE | 3348033 C2 | | 9/1983 |
| DE | 3808465 A1 | | 9/1988 |
| DE | 3835634 A1 | | 5/1989 |
| DE | 4112434 A1 | | 10/1992 |
| DE | 4131608 A1 | | 3/1993 |
| DE | 4233819 A1 | | 4/1994 |
| DE | 42 33 819 A1 | | 4/1994 |
| DE | 4446161 A1 | | 6/1996 |
| EP | 0 534 229 A1 | | 3/1993 |

OTHER PUBLICATIONS

European Search Report.
Foreign Search Report Abstract.

*Primary Examiner*—Donald P. Walsh
*Assistant Examiner*—Minh-Chau Pham
(74) *Attorney, Agent, or Firm*—Kennedy Covington Lobdell & Hickman, LLP

(57) ABSTRACT

A method for performing a batch change in an automatic cheese winder, which has many identical winding stations disposed in sections and a transportation system for supplying yarn-wound spinning cops to and removing empty unwound spinning cops from the winding stations. Transport trays for transporting spinning cops or empty tubes revolve within the transportation system, which has many different transport paths, among others transverse transport paths leading to the winding stations. The clearing away of an old batch of yarn is done section by section. Thus, from the transverse transport paths of one winding station section, spinning cop-carrying transport trays are discharged until such time as that section has been cleared out. The temporary storage of empty transport trays in the transverse transport paths of a cleared winding station section is already begun while adjacent winding station sections are still being cleared. When the automatic cheese winders are being filled with spinning cops from a new batch of yarn, at the same time one empty transport tray per transverse transport path is discharged out of the transverse transport paths, and the free spaces thus created on the transverse transport paths are filled uniformly via the storage path with transport trays that carry spinning cops with the new batch of yarn.

12 Claims, 4 Drawing Sheets

U.S. PATENT DOCUMENTS 5,240,193 A * 8/1993 Backhaus ..... 242/474.1 X
5,323,979 A 6/1994 Grecksch et al. ..... 242/35.5 A
5,423,493 A 6/1995 Rueth et al. ..... 242/35.5 A
5,484,115 A * 1/1996 Wirtz ..... 242/474.1
5,509,614 A * 4/1996 Nishikawa et al. ..... 242/474
5,544,829 A * 8/1996 Bucken et al. ..... 242/474.1
5,685,409 A 11/1997 Bruss et al. ..... 198/457
5,845,864 A * 12/1998 Hermanns et al. ..... 242/474.1
6,089,494 A * 7/2000 Tholen et al. ..... 242/474.1
6,290,165 B1 * 9/2001 Mund et al. ..... 242/474

* cited by examiner

METHOD FOR OPERATING AN AUTOMATIC CHEESE WINDER WHEN CHANGING BATCHES

CROSS-REFERENCES TO RELATED APPLICATIONS

This application claims the benefit of German patent application DE 19854375.1, filed Nov. 25, 1998, herein incorporated by reference.

FIELD OF THE INVENTION

The present invention relates to a method for performing a batch change in an automatic cheese winder having multiple identical winding stations arranged in sections and a transportation system for supplying yarn-wound spinning cops to, and removing empty unwound tubes from, the winding stations, wherein the transportation system has a plurality of transport trays for supporting the spinning cops and the empty tubes and a plurality of transport paths for travel therealong of the transport trays.

BACKGROUND OF THE INVENTION

Modern automatic cheese winders as a rule have many identical winding stations disposed in sections, as well as a transport system for supplying and removing these winding stations with spinning cops and empty tubes, respectively. Revolving within such a transport system, which system typically has a plurality of different transport paths including the transverse transport paths leading to the winding stations, are transport trays with vertically disposed receiving mandrels, and either spinning cops or empty tubes which are fed on these trays. Processing stations for the spinning cops and empty tubes, as applicable, are typically also disposed in the region of these transport systems. Examples include cop preparation stations, tube monitors, and tube cleaners.

The transport system of an automatic cheese winder can either be connected via a so-called converter directly to the transport system of a preceding textile machine that produces spinning cops, which is then called a compound textile machine, or can be provided with spinning cops from a separately disposed ring spinning machine, or can be removed of empty tubes, via a special interface.

Such an interface for instance comprises a cop mounting device, which is disposed in the region of a so-called takeover path and precedes a flat circular conveyor, and a tube doffer. All of these are known in principle, for example: cop mounters from German Patent Disclosure DE 33 48: 033 C2, flat circular conveyors from German Patent Disclosure DE 41 12 434 A1, and a tube doffer from German Patent Disclosure DE 44 46 161 A1.

In such a separate transport system for a bobbin winding machine, the spinning cops, shipped in relatively large shipping containers, are first separated and set upright in flat circular conveyors. Next, the spinning cops are positioned by the cop mounter on the transport trays revolving in the transport system.

Discharged empty tubes are taken out of the transport system by the tube doffer and stored temporarily in a shipping container.

In the aforementioned transport systems, the number of transport trays circulating in the transport system usually markedly exceeds the number of winding stations in the automatic cheese winder. Preferably, the number of circulating transport trays is approximately five times the number of winding stations. These transport trays have to be empty first when a batch is changed, yet they still remain in the transport system. In such transport systems, as known for instance also from German Patent Disclosure DE 42 33 819 A1, problems can arise in terms of the transport tray logistics, and as a result, a batch change takes a relatively long time, which means a loss of production.

OBJECT AND SUMMARY OF THE INVENTION

Based on the automatic cheese winders of the generic type described above and their transport systems, an object of the present invention is to develop a method that improves the performance of such a batch change in an automatic cheese winder.

According to the present invention, this object is attained by a method for performing a batch change in an automatic cheese winder. This automatic cheese winder has multiple identical winding stations arranged in sections and a transportation system for supplying yarn-wound spinning cops to, and removing empty unwound tubes from, the winding stations. The transportation system has a plurality of transport trays for supporting the spinning cops and the empty tubes and a plurality of transport paths for travel therealong of the transport trays. Among the transport paths is a storage path extending along the winding stations for storing transiently a plurality of transport trays with spinning cops supported thereon and a plurality of winding station transport paths including transverse transport paths each extending from the storage path through a respective winding station. The method of the present invention comprises clearing a first batch of spinning cops from the winding stations section by section. In each section, this method involves discharging from the respective section transport trays having spinning cops thereon and removing the spinning cops from the transport trays to create empty transport trays, and temporarily retaining the empty transport trays in the winding station transport paths while clearing the first batch of spinning cops from other winding station sections. The method also comprises filling the automatic cheese winder with a second batch of spinning cops by successively discharging one empty transport tray from each winding station transport path of each winding station section and delivering in place thereof a transport tray supporting a spinning cop of the second batch, thereby for uniformly filling the winding stations of the winding station sections.

Advantageous features of this method are set forth in more detail herein.

As compared to the methods known thus far, the method of the present invention has the advantage that clearing out an old batch of yarn, temporarily storing the empty transport trays, and filling up the new batch of yarn proceeds in an entirely controlled fashion from the very beginning.

The transverse transport paths leading to the winding stations are used as temporary storage reservoirs for empty transport trays. These paths can be loaded in a defined way without requiring any additional blocking or control means whatsoever in the inlet region to these transverse transport paths.

In other words, when the spinning cops of an old batch of yarn are being cleared away, the empty transport trays, relieved of their spinning cops, are immediately taken out of the transport loop of the automatic cheese winder and distributed sectionally to the transverse transport paths over the storage path. Three of the total of five transport trays present per winding station are discharged in succession into the transverse transport paths. At the end of the clearing process, the two remaining; transport trays are temporarily stored on the tube return path or the distributor path and are immediately ready there for filling with spinning cops that hold a new batch of yarn.

When the automatic cheese winder is being filled with spinning cops of a new batch of yarn, it is also assured, by purposeful discharging of the empty transport trays temporarily stored in the transverse transport paths, that all the winding stations of the automatic cheese winder will be supplied relatively uniformly with spinning cops holding the new batch of yarn, and thus all the winding stations can begin production simultaneously.

Since the temporary storage of empty transport trays in transverse transport paths of a cleared winding station section is already begun while the transverse transport paths of adjacent winding station sections are still being cleared, and since it is also assured that all the winding stations of the automatic cheese winder can enter production without delay, the batch change method according to the present invention is distinguished by its great speed. The method of the present invention leads overall to an improvement in the efficiency of an automatic cheese winder.

It has been proven to be especially advantageous in the method of the present invention wherein clearing away of an old batch of yarn and temporarily storing empty transport trays in the transverse transport paths begins at the winding station sections that are most downstream relative to the transport direction of a cop delivery path. In this way, it is easily possible to separate spinning cop-laden transport trays, which still have to be unloaded, and empty transport trays, that are to be temporarily stored, in a simple and reliable manner.

The method step wherein one transport tray carrying spinning cops per transverse transport path is discharged onto a tube return path, when clearing away of the old batch of yarn begins, assures on the one hand, particularly in conjunction with the method step of temporarily shutting off the connecting path before beginning to empty the last winding station sections in terms of transport direction of the cop delivery path and the method step of activating a stop device installed on a tube return path and impounding the transport trays carrying spinning cops after the transverse transport paths of some of the winding station sections have been empty, that the spinning cop-laden transport trays will be discharged out of the transverse transport paths of a winding station section rapidly. On the other hand, in this way, the occurrence of a backup of the discharged transport trays along the tube return path and attendant blockages of these transport trays in the mouth region of the transverse transport paths is precluded, because such blockages can often be cleared away only by hand.

In a preferred embodiment of the present invention, it is provided that the branch paths disposed first in terms of the transport direction of the cop delivery path are discharged toward the storage path, while the last of the branch paths dispenses the transport trays to the cop delivery path. Since the transport trays discharged to the cop delivery path are retrieved first, in this way the stream of spinning cop-carrying transport trays to be unloaded in a doffing path can be evened out somewhat.

The method step of triggering drives of the storage path in such a way that the transport trays carrying spinning cops located on the storage path are transported along the storage path counter to the transport direction of the cop delivery path after emptying of preparation paths disposed in a region of cop preparation stations via the branch paths and the method step of unloading onto a doffing path the transport trays carrying spinning cops that are discharged successively out of the transverse transport paths of the winding station sections assure that the storage path leading to the transverse transport paths is freed up immediately, especially in the region of the rear branching path, so that discharging empty transport trays into the transverse transport paths of the winding station sections cleared first can be begun without delay.

A cop removing device disposed preferably in the region of a doffing path assures that the spinning cops of the old batch of yarn are taken continuously, and the yarn layers are taken gently, from the transport trays.

The method step wherein a portion of the storage path initially has a transport direction counter to a usual storage path when temporarily storing the transport trays in the transverse transport paths of the winding station section that was cleared first begins, the method step wherein the spinning cops are conducted via leading branch paths onto the storage path and are fed by way of the storage path into the transverse transport paths of the winding station sections when the automatic cheese winder is being filled with a new yarn batch, and the method step wherein transporting the spinning cops on the storage path initially counter to the transport direction of the cop delivery path and after that are transported in the transport direction of the cop delivery path when a new yarn batch is being filled, again have a very positive effect on a rapid course of the batch change process. Thus, they have a very positive effect on the efficiency of the automatic cheese winder because these method steps either speed up the temporary storage of empty transport trays or assure the uniform filling of all the winding stations of the automatic cheese winder with spinning cops of the new batch of yarn.

Further details of the invention can be learned from a preferred embodiment described and exemplified below in conjunction with the drawings.

Each of FIGS. 2–8 show an individual method step in performing the batch changing method of the present invention.

DESCRIPTION OF THE PREFERRED EMBODIMENT

Figure 1:
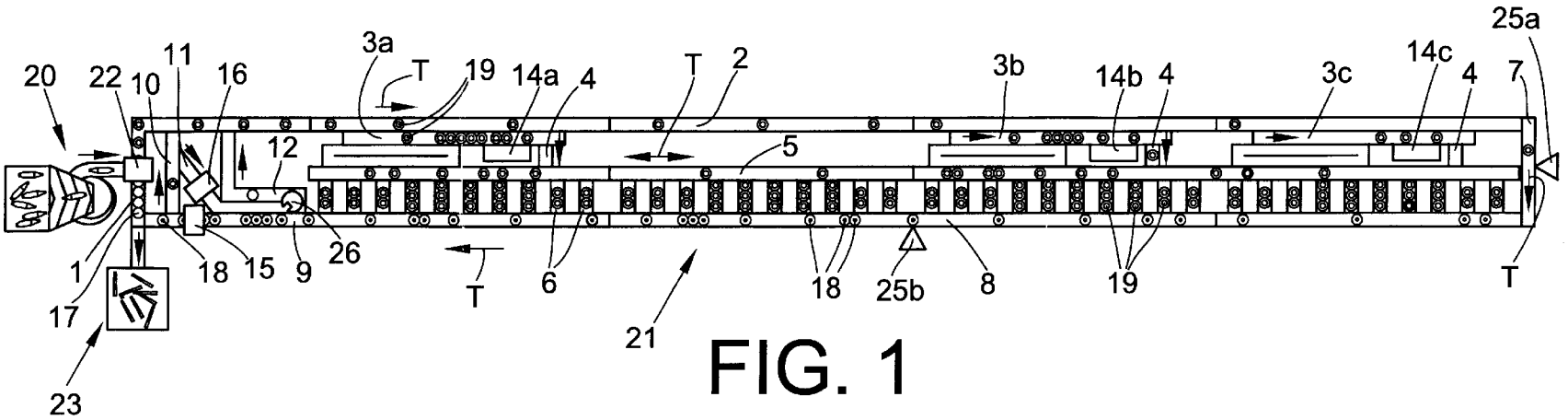
FIG. 1 is a plan view on the transport system of an automatic cheese winder during normal bobbin winding operation.

FIG. 1 schematically indicates a transport system 21 of an automatic bobbin winder (not shown). In the embodiment shown, the transport system 21 is supplied, via an interface known as a cop mounter 22, with spinning cops that have been made in a separate ring spinning machine. Empty tubes are removed via the empty tube doffer 23 and are then fed back to the ring spinning machine.

FIG. 1 shows a situation as it occurs during normal bobbin winding operation. Such transport systems 21, known per se, have many different transport paths, by way of which the winding stations of the automatic cheese winder are supplied with spinning cops and are removed of empty tubes.

In FIG. 1, in the region of a transfer path 1, a flat/round conveyor 20 is indicated, with a cop mounting device 22 and an empty tube doffer 23. In a known manner, in such transport systems the transfer path 1 is adjoined by a cop delivery path 2, from which branch paths or preparation paths 3*a*, 3*b*, 3*c* depart. A preparation station 14*a*, 14*b*, 14*c* is disposed adjacent to each branch path or preparation path 3*a*, 3*b*, 3*c*. The branch paths or preparation paths 3*a*, 3*b*, 3*c* are connected via discharge paths 4 to a storage path 5, which in turn communicates via numerous transverse transport paths 6 with a tube return path 8. The tube return path 8 is adjoined by a distributor path 9, which opens into the transfer path 1.

The tube path 8 is connected via a connecting path 7 to the cop delivery path 2. Stopping devices 25*a* and 25*b* that can be acted upon in the defined way are installed in the region of the connecting path 7 and in the region of he tube return path 8, respectively.

From the distributor path 9, on which a tube monitor 15 is disposed, a so-called transverse passage 10 leads away, extending between the distributor path 9 and the cop delivery path 2; connected to the transverse passage is a tube cleaning path 11 with a tube cleaner 16 disposed on it. The tube cleaning path 11, finally, merges with a manual preparation path functioning as a doffing path 12. The cop doffer 26 is disposed in the region of the doffing path 12.

During normal bobbin winding operation, numerous transport trays, equipped with either spinning cops or empty tubes, circulate within the transport system 21. As a rule, the transport trays are briefly empty only in the region of the transfer path 1 between the empty tube doffer 23 and the cop mounter 22.

In FIG. 1, spinning cop-carrying transport trays are indicated by reference numeral 19, empty tube-equipped transport trays by reference numeral 18, and empty transport trays by reference numeral 17. The transport trays revolve in the transport direction T within the transport system 21.

Figure 2:
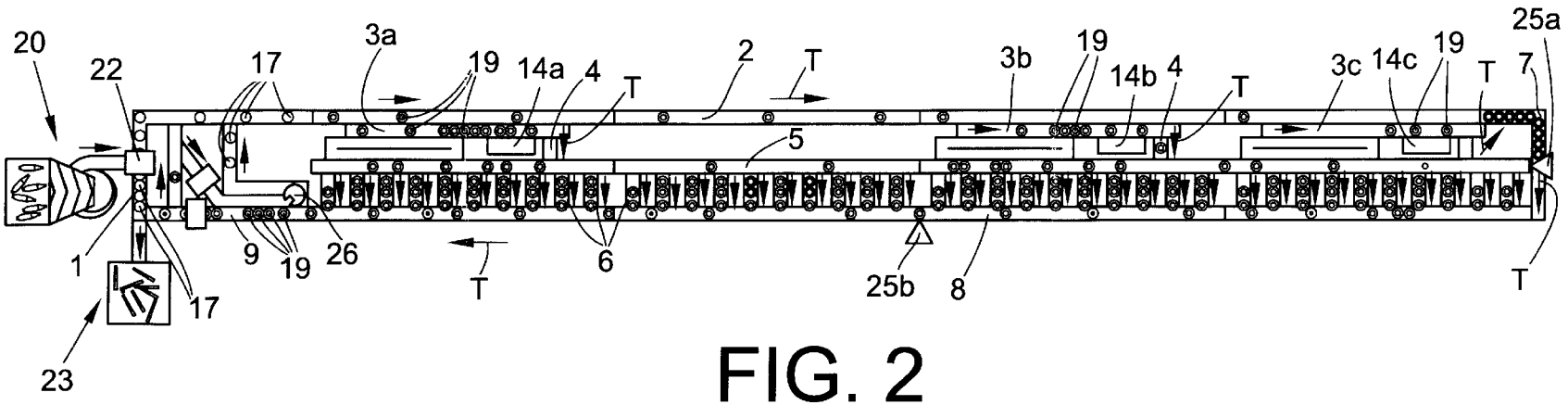

FIG. 2 shows the situation at the beginning of the batch changing method of the invention. The winding stations (not shown) of the automatic cheese winder have ceased their winding operation. The cop mounting device 22, disposed in the region of the transfer path 1, is switched to discharging; that is, empty transport trays 17 that arrived are no longer supplied with spinning cops but instead run directly through to the cop delivery path 2. At the same time, the branching and preparation paths 3*a*, 3*b* and 3*c* are triggered such that the spinning cop-carrying transport trays 19 on them are discharged.

The transport trays 19 on the branching and preparation paths 3*a* and 3*b* are sent to the storage path 5 via the discharge paths 4, while the transport trays 19 on the branching and preparation path 3*c* are discharged to the cop delivery path 2.

At the same time, from all the transverse transport paths 6, a spinning cop-carrying transport tray 19 is discharged to the tube return path 8, and the connecting path 7 is temporarily taken out of operation, e.g., by activating a stopping device 25*a*.

The spinning cop-equipped transport trays 19 are discharged by the tube monitor 15 to the doffing path 12, where they are unloaded either by machine, using a cop doffer 26, or manually the operators. Empty tube-carrying transport trays 18 are discharged by the tube monitor to the transfer path 1, where they are freed of the tubes by an empty tube doffer 23.

Figure 3:
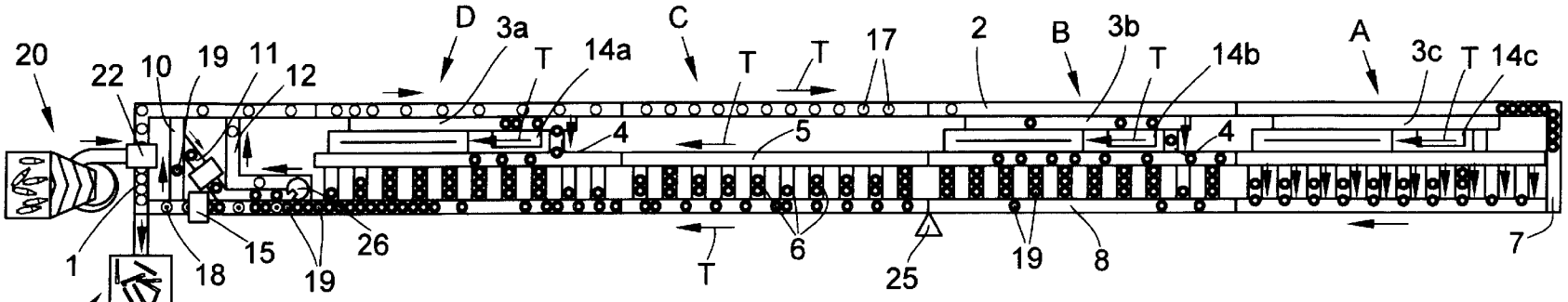

As seen in FIG. 3, next the drive of the storage path 5 is triggered such that the conveyor belt of the storage path 5, which in normal bobbin winding operation is driven to reverse back and forth, maintains the same running direction, which is opposite the transport direction of the cop delivery path 2. The storage path 5 is cleared of spinning cop-carrying transport trays in the region of the winding station section A because of this running direction. From the winding station section A, successive spinning cop-laden transport trays are also discharged; this discharging is done such that all the transverse transport paths 6 of the winding station section A each simultaneously discharge one transport tray 19 to the tube return path 8.

Figure 4:
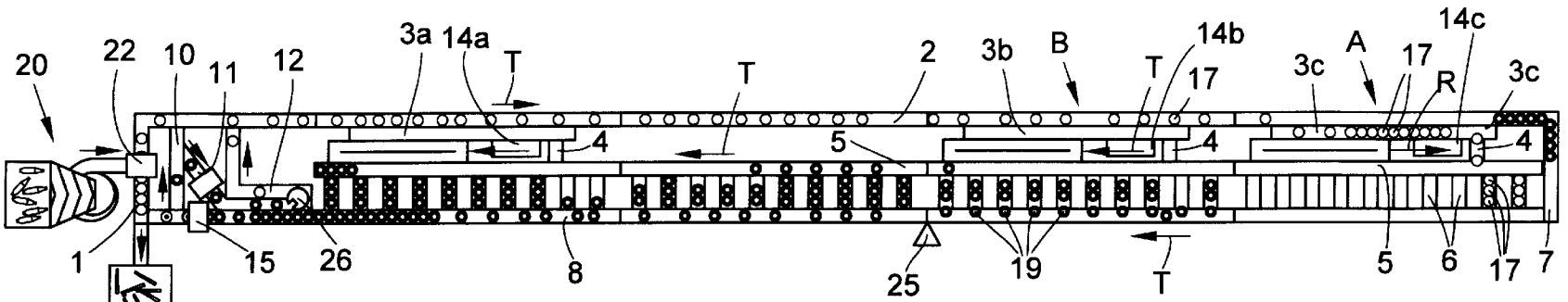
Figure 5:
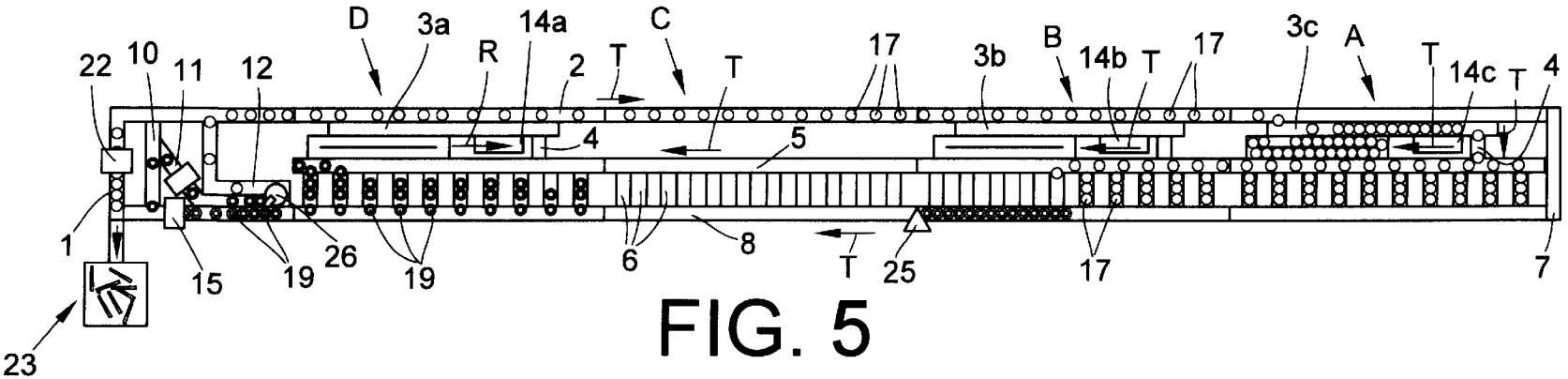

As seen from FIG. 3 and especially FIG. 4, while the winding station section A is still being cleared of the spinning cop-laden transport trays 19, empty transport trays 17 are already being brought via the cop delivery path 2.

These empty transport trays 17 are already, as suggested in FIG. 4, discharged into the transverse transport paths 6 of the cleared winding station section A via the branching and preparation path 3*c* while the clearing of the transverse transport paths 6 is still going on in the winding section B. As soon as the winding station section A has been cleared, the connecting path 7 is also put back into operation, e.g., by deactivating the stopping device 25*a*.

In the temporary storage of the empty transport trays 17, the storage path 5 is initially switched in the running direction R in the region of the winding station section A.

When the winding station section B is being cleared as well, one spinning cop-laden transport tray 19 per transverse transport path 6 is discharged simultaneously. This method step is repeated until this winding station section has also been cleared.

In the manner described above, all the winding station sections A, B, C, D and so forth of the automatic cheese winder are successively freed of spinning cop-carrying transport trays 19, and these transport trays are empty of the spinning cops of the old batch of yarn in the doffing path 12. At the same time, in corresponding order, the transverse transport paths 6 of the winding station sections A, B, C, D and so forth are refilled with empty transport trays 17 via the cop delivery path 2 and the branching and preparation path 3*c*, as indicated for instance in FIG. 5.

As soon as the first winding station sections, that is, in the present exemplary embodiment that the winding station sections A and B have been freed of spinning cop-carrying transport trays 19, a stopping device 25*b* in the region of the tube return path 8 is activated. The spinning cop-carrying transport trays 19 are impounded upstream of the stopping device 25*b* until all the winding station sections have been cleared. Next, the stopping device 25*b* is also deactivated, and the transport trays are freed of the spinning cops along the doffing path 12.

Figure 6:
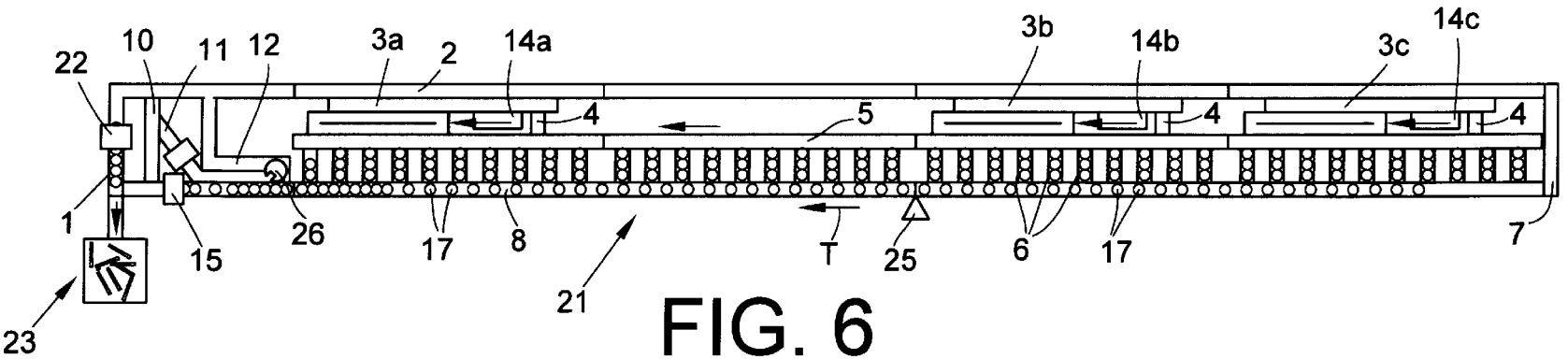

FIG. 6 shows a situation that occurs when all the spinning cops and empty tubes of the old batch of yarn have been removed from the transport system 21 of the automatic cheese winder, and now only empty transport trays 17 for receiving the spinning cops of the new batch of yarn are ready in the transverse transport paths 6 and along the tube return path 8 and the distributor path 9. As indicated, approximately sixty (60) percent of the empty transport trays have been temporarily stored in the transverse transport paths 6, and approximately forty (40) percent of them have been temporarily stored along the tube return path 8.

The ensuing filling of the winding stations of the automatic cheese winder with spinning cops of the new yarn batch proceeds, in principle, similarly to the emptying process described above.

Figure 7:
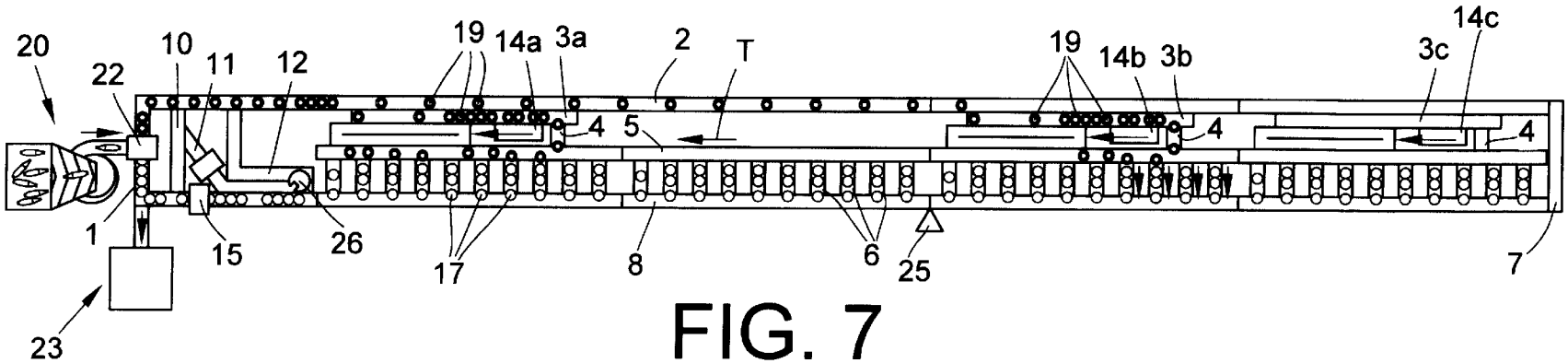
Figure 8:
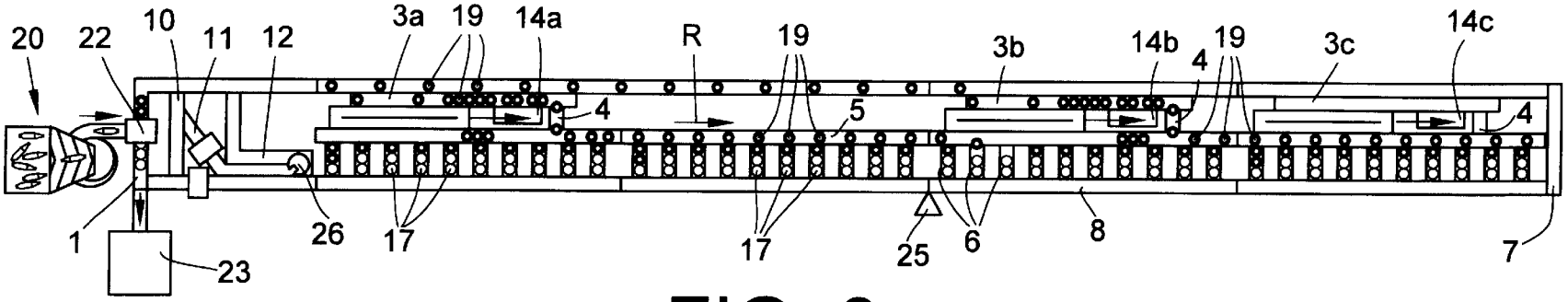

As indicated in FIG. 7, first the empty transport trays 17 in readiness along the tube return path 8 are equipped with spinning cops of the new yarn batch at the cop mounting device 22. These transport trays 19 are fed via the cop delivery path 2 to the branching and preparation paths 3*a* and 3*b*, where they are processed in the usual way by the preparation stations 14*a* and 14*b*. The spinning cops prepared in the preparation stations 14*a* and 14*b* pass over the preparation paths 3*a* and 3*b* and the discharge paths 4 to reach the storage path 5, whose conveyor belt initially runs in the direction of the leading preparation station 14*a*.

At the same time, one empty transport tray 17 is discharged out of each of all the transverse transport paths 6 of the transport system 21, as indicated in FIG. 7, thus creating space in the transverse transport paths 6 for receiving a respective spinning cop-equipped transport tray 19 each. By way of the storage path 5, which is at least intermittently switched to reverse R, these free spaces on all the transverse transport paths 6 are filled with a transport tray that carries a spinning cop of the new batch of yarn.

The method described above is repeated until all the empty transport trays 17 have been discharged out of the transverse transport paths 6 and at the same time replaced with transport trays 19 that carry spinning cops of the new batch of yarn.

In the manner described above, individual winding stations are prevented from being unable to operate because of a lack of spinning cops. In other words, it is assured that all the winding stations of the automatic cheese winder can take up their operation simultaneously.

The batch changing process is thus ended, and the automatic cheese winder resumes normal bobbin winding operation.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for performing a batch change in an automatic cheese winder having multiple identical winding stations arranged in sections and a transportation system for supplying to the winding stations spinning cops comprised of yarn-wound on cop tubes, and removing from the winding stations empty cop tubes from which the yarn has been unwound, wherein the transportation system has a plurality of transport trays for supporting initially the spinning cops and subsequently the empty tubes and a plurality of transport paths for travel therealong of the transport trays including a storage path having drives extending along the winding stations for storing transiently a sub-plurality of the plurality of transport trays with spinning cops supported thereon and a plurality of winding station transport paths including transverse transport paths each extending from the storage path through a respective winding station, the method comprising:

a) clearing a first batch of spinning cops from the winding stations section by section including, for each section in sequence:

(i) discharging from the section transport trays having spinning cops thereon and removing the spinning cops from the transport trays to create empty transport trays, and (ii) temporarily retaining the empty transport trays in the winding station transport paths while clearing the first batch of spinning cops from other winding station sections, and b) filling the automatic cheese winder with a second batch of spinning cops by successively discharging one empty transport tray from each winding station transport path of each winding station section and delivering in place thereof a transport tray supporting a spinning cop of the second batch, thereby for uniformly filling the winding stations of the winding station sections.

2. The method of claim 1, wherein the transportation system includes a cop delivery path extending along the winding stations and operative to convey transport trays supporting spinning cops in a transport direction along the winding stations, and wherein the clearing of the first batch of spinning cops begins at the winding station section most downstream relative to the transport direction of the cop delivery path.

3. The method of claim 1, wherein the transportation system includes a tube return path extending along the winding stations, and when clearing away the first batch of spinning cops begins, one transport tray carrying spinning cops per transverse transport path is discharged onto the tube return path.

4. The method of claim 1, wherein the transportation system includes a connecting path, a tube return path extending along the winding stations and a cop delivery path extending along the winding stations operative to convey transport trays supporting spinning cops in a transport direction along the winding stations, and further comprising triggering branch paths branching off from the cop delivery path such that the branch path which is most downstream relative to the transport direction of the cop delivery path, discharges the transport trays carrying spinning cops to the cop delivery path and by way of the connecting path, to the tube return path, while the branch paths which are most upstream relative to the transport direction of the cop delivery path discharge transport trays carrying spinning cops to the storage path.

5. The method of claim 4, wherein the transportation system includes preparation paths, and further comprising triggering the drives of the storage path such that the transport trays carrying spinning cops located on the storage path are transported along the storage path counter to the transport direction of the cop delivery path after emptying of the preparation paths disposed in a region of cop preparation stations by way of the branch paths.

6. The method of claim 4, wherein the empty transport trays brought to the cop delivery path are transported by way of the branch path which is most downstream on the storage path and by way of the storage path are fed into the transverse transport paths of the cleared winding station sections.

7. The method of claim 6, wherein when temporarily retaining the transport trays in the transport paths of the winding station section that was cleared first begins, a portion of the storage path initially has a transport direction counter to the transport direction typical of the storage path.

8. The method of claim 1, wherein the transportation system includes a doffing path, and further comprising unloading onto the doffing path the transport trays carrying spinning cops that are discharged successively out of the transverse transport paths of the winding station sections.

9. The method of claim 1, wherein the transportation system includes leading branch paths and a cop delivery path extending along the winding stations operative to convey transport trays supporting spinning cops in a transport direction along the winding stations, and wherein when the automatic winder is being filled with a second batch, the spinning cops are transported by way of the leading branch paths onto the storage path and are fed by way of the storage path into the transverse transport paths of the winding station sections.

10. The method of claim 9, wherein when filling the automatic winder with the second batch, transporting the spinning cops on the storage path initially counter to the transport direction of the cop delivery path and thereafter transporting the spinning cops in the transport direction of the cop delivery path.

11. The method of claim 1, wherein the transportation system includes a connecting path and a cop delivery path extending along the winding stations operative to convey transport trays supporting spinning cops in a transport direction along the winding stations, and further comprising temporarily shutting off the connecting path before beginning to empty the winding station sections which are most downstream relative to the transport direction of the cop delivery path.

12. The method of claim 1, wherein the transportation system includes a tube return path extending along the winding stations, and further comprising activating a stopping device installed on the tube return path and impounding the transport trays carrying spinning cops after having emptied the transverse transport paths of at least one winding station section.

* * * * *